United States Patent [19]

Shirata et al.

[11] Patent Number: 5,050,545

[45] Date of Patent: Sep. 24, 1991

[54] ENGINE PREHEATING SYSTEM

[75] Inventors: Akihiro Shirata, Yokohama; Toshifumi Koshizawa, Kawasaki; Yuichi Koyama, Machida; Ken Kurabayashi, Chigasaki, all of Japan

[73] Assignee: Isuzu Motors, Ltd., Tokyo, Japan

[21] Appl. No.: 501,749

[22] Filed: Mar. 30, 1990

[30] Foreign Application Priority Data

Sep. 29, 1989 [JP] Japan ..... 1-254498

[51] Int. Cl.[5] ..... F02P 19/02

[52] U.S. Cl. ..... 123/179 H; 123/145 A

[58] Field of Search ..... 123/179 H, 179 BG, 179 B, 123/145 A

[56] References Cited

U.S. PATENT DOCUMENTS 4,478,181 10/1984 Kikuchi et al. ..... 123/179 H
4,635,594 1/1987 Ichikawa et al. ..... 123/179 H

FOREIGN PATENT DOCUMENTS 2098762 3/1972 France .
2069044 8/1981 United Kingdom .
2125481 3/1984 United Kingdom .

*Primary Examiner*—Andrew M. Dolinar
*Attorney, Agent, or Firm*—Staas & Halsey

[57] ABSTRACT

An engine preheating system preheats an engine such as a diesel engine efficiently and quickly with heating members such as self-temperature-controlling glow plugs. When the engine is to be preheated quickly, a voltage to be applied to the heating members is increased by electric energy stored in a capacitor capacitors, and a large current is supplied to the heating members to preheat the engine in a short period of time.

4 Claims, 4 Drawing Sheets

KEYSWITCH
ST
IG
OFF
INDICATOR LAMP
ON
OFF
CHARGE RELAY
ON
OFF
INDICATOR TIMER
ON
OFF
AFTERGLOW TIMER
ON
OFF
VEHICLE SPEED
S2
S1
2ND RELAY 10
ON
OFF
1ST RELAY 2
ON
OFF
GP TEMPERATURE
GP
ti
ta
TIME

ENGINE PREHEATING SYSTEM

BACKGROUND OF THE INVENTION

1. Field of the Invention

The present invention relates to an engine preheating system for controlling a heating member to quickly preheat an engine such as a diesel engine.

2. Description of the Prior Art

To start a diesel engine quickly in cold climate, an electric current is supplied from a battery to a heating member such as a glow plug to preheat the same, for assisting in starting the engine. Recent years have seen the development of a self-temperature-controlling glow plug. Such a self-temperature-controlling glow plug is used to start a diesel engine quickly. More specifically, when a keyswitch associated with the engine is turned on, a large current is supplied to the glow plug to quickly preheat the same within a short period of time. Alternatively, when a quick-acting afterglow function is to be performed after the keyswitch is turned off, a large current is supplied to the glow plug to quickly preheat the same for stabilizing engine idling immediately after the engine is started.

One self-temperature-controlling glow plug is disclosed in Japanese Patent Application No. 58(1983)-182459. The disclosed glow plug comprises a heating coil and a piece of magnesium oxide which are inserted in a sheath which is resistant to heat and corrosion. The heating coil comprises two coil elements having different resistance temperature coefficients, the coil elements being connected in series with each other. These heating coil elements are referred to a rush coil and a brake coil, respectively, which are named after the functions to be performed thereby. The rush coil is disposed in a front end portion of the sheath, and the brake coil is disposed in a rear end portion of the sheath. The resistance temperature coefficient of the rush coil is constant irrespective of the temperature, but the resistance temperature coefficient of the brake coil is higher as the temperature becomes higher.

When the self-temperature-controlling glow plug starts to be preheated, the rush coil element is first heated red quickly. If the quickly heated condition continued for a long time, the temperature of the glow plug would become higher than necessary, resulting in a coil breakage. To avoid this, the resistance of the brake coil element is increased with the temperature rise, thereby reducing the supplied current. As a result, the temperature of the glow plug is prevented from rising excessively, but is kept at a preset level.

When the self-temperature-controlling glow plug is employed in an engine preheating system, it is preferable to supply a large current to the rush coil within a short period of time when the glow plug begins to be preheated, so that the glow plug will quickly be heated to a preset temperature of such as 800° C., for example. However, the batteries on general motor vehicles cannot supply such a large current when starting to preheat the glow plug.

SUMMARY OF THE INVENTION

In view of the aforesaid problems of the conventional engine preheating system, it is an object of the present invention to provide an engine preheating system which can supply a large current to a glow plug within a short period of time so that the time required to preheat the glow plug is reduced.

According to the present invention, there is provided an engine preheating system for preheating a diesel engine, comprising a heating member heatable by a current flowing therethrough for heating the diesel engine, a power supply for applying a voltage to the heating member, a capacitor chargeable by the power supply, and connection control means for connecting the capacitor and the power supply in series with each other when the diesel engine is to be preheated quickly.

When the engine is to be preheated quickly, a current to be supplied from the power supply to the heating member is increased by electric energy discharged from the capacitor, thereby shortening the period of time required to preheat the engine.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
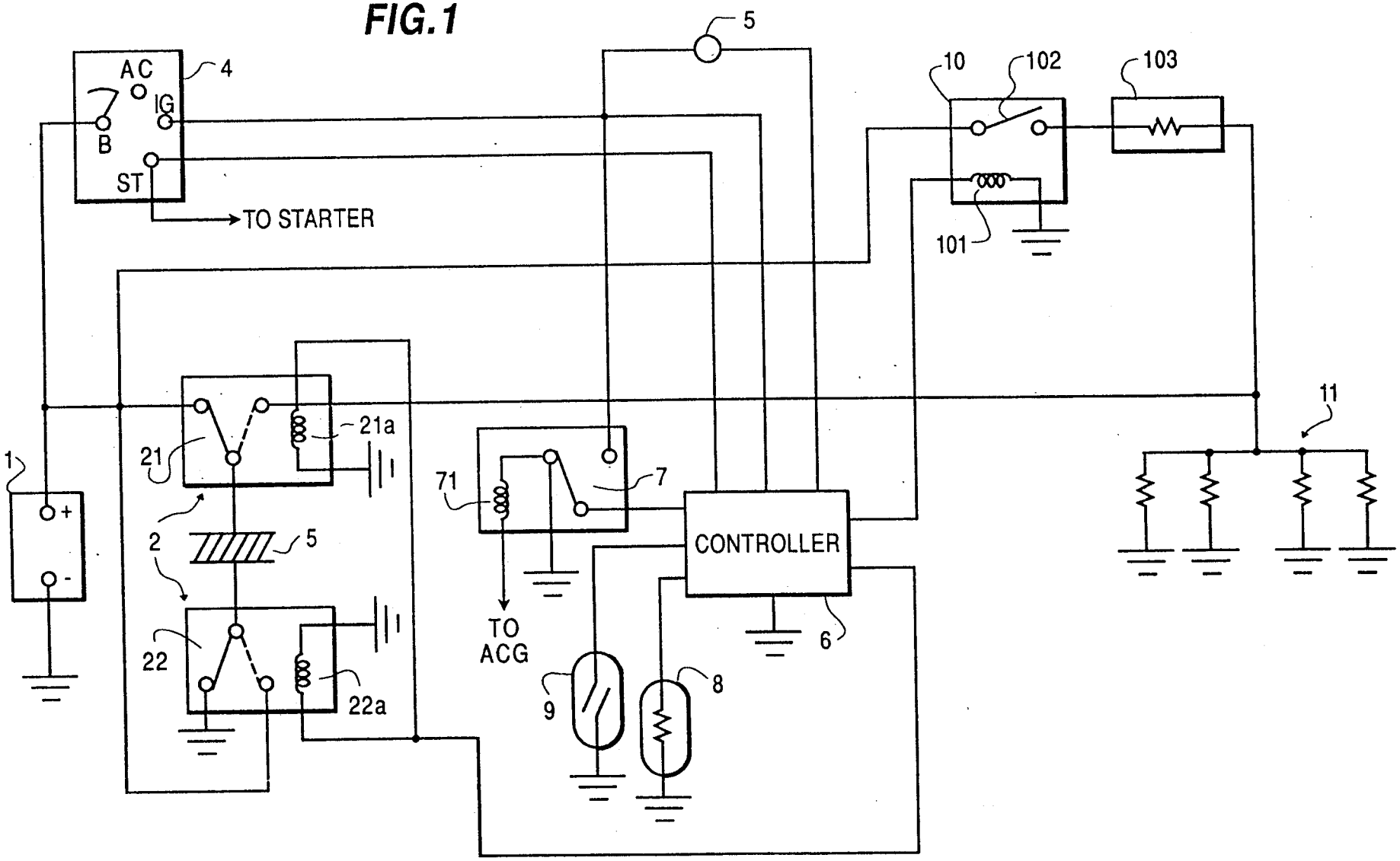
FIG. 1 is a block diagram of an engine preheating system according to an embodiment of the present invention.

FIG. 1 shows a engine heating system according to an embodiment of the present invention.

A battery 1 such as a lead storage battery is connected to heating members 11 such as self-temperature-controlling glow plugs which are associated respectively with the cylinders of an engine such as a diesel engine, so that the voltage of the battery 1 can be applied to the heating members 11. The battery 1 is connected through a first relay 2 to a capacitor 3 which supplies a large current within a short period of time to the rush coils of the heating members 11 when the engine starts to be preheated. The battery 1 has a negative terminal connected to ground and a positive terminal to the opposite electrodes of the capacitor 3 through relay switches 21, 22, respectively, of the first relay 2. When the relay switches 21, 22 are in the solid-line position (turned off), the capacitor 3 can be charged by the battery 1. When the first relay 2 is energized to shift the relay switches 12, 22 simultaneously from the solid-line position to the broken-line position (turned on), the capacitor 3 is connected in series with the battery 1.

A keyswitch 4 has an accessory contact AC, an ignition contact IG, and a starter contact ST. The keyswitch 4 also has a movable contact B connected to the positive terminal of the battery 1, for supplying electric energy from the battery 1 to various electric circuits connected to the keyswitch 4. The starter contact ST is coupled to an engine starter motor.

A glow indicator lamp 5 is connected between the ignition contact IG and a controller 6 which controls energization and de-energization of the heating members 11 which preheat the engine. When the keyswitch 4 is turned to connect the movable contact B to the ignition contact IG, the glow indicator lamp 5 is turned on and continues to be energized for a preheating wait time depending on the temperature of the engine coolant at the time. When the glow indicator lamp 5 is turned off, the driver can know that the preheating of the engine is completed. Between the ignition contact IG of the keyswitch 4 and the controller 6, there is also connected a charge relay 7 whose relay coil 71 is connected to an alternator ACG. The controller 6 includes an indicator timer for presetting a preheating wait time and an afterglow timer for presetting an afterglow time when the rotational speed of the engine is low.

A thermosensor 8 and a speed sensor 9 are connected to the controller 6 to supply the same with a signal indicative of an engine coolant temperature and a signal indicative of an engine rotational speed. The controller 6 is also supplied with signals from the ignition contact IG and the starter contact ST of the keyswitch 4, and electric energy from the battery 1 or the alternator ACG through the charge relay 7. The controller 6 applies control signals to relay coils 21*a*, 22*a* of the first relay 2, the glow indicator lamp 5, and a relay coil 101 of a second relay 10. The second relay 10 has a relay switch 102 connected in series with a dropping resistor 103. When the heating members 11 and the battery 1 are connected to each other through the series circuit of the relay switch 102 and the dropping resistor 103, the heating of the heating members 11 can be stably controlled.

Figures 2A, 2B, 2C:
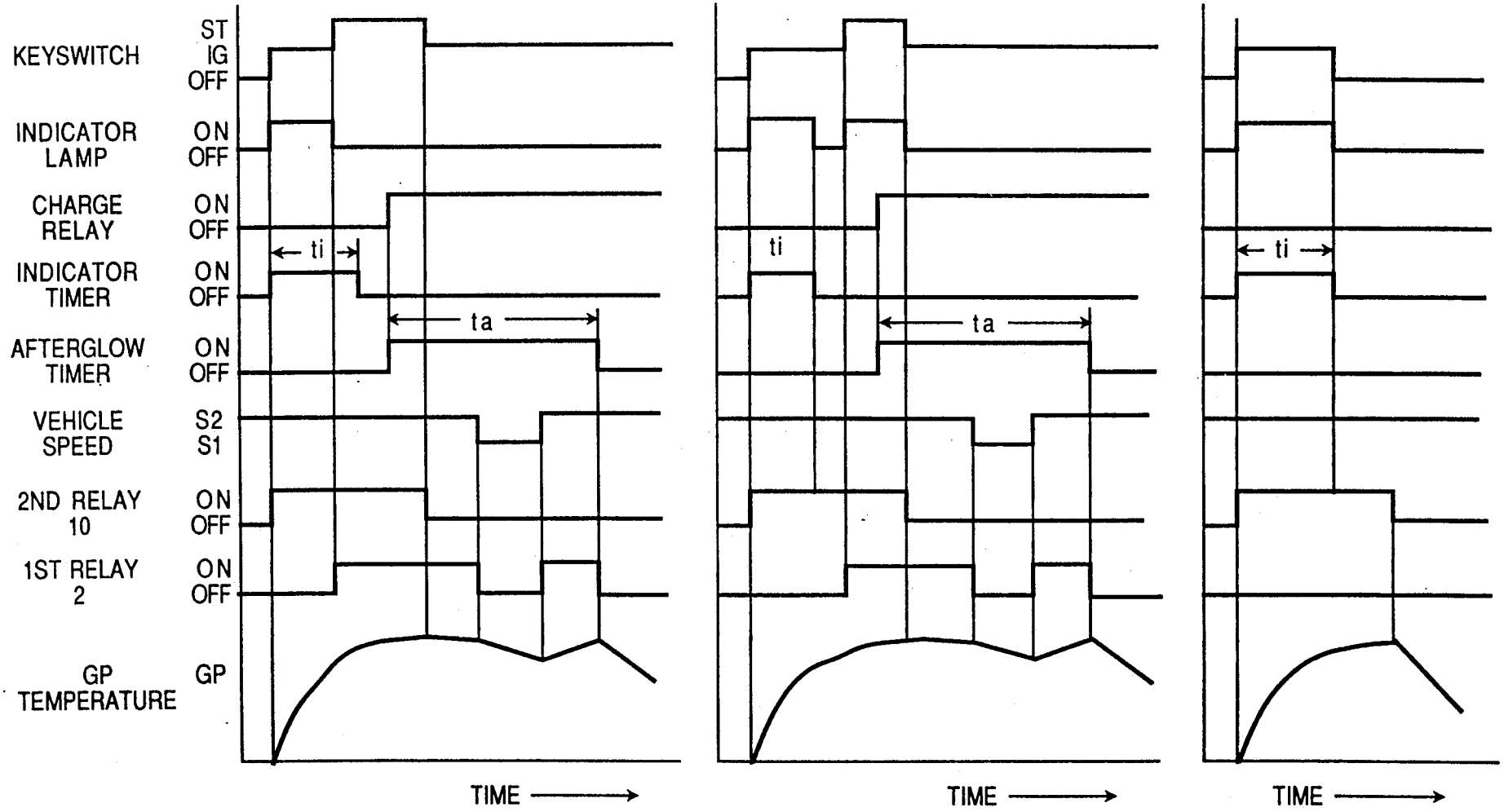
FIGS. 2(*a*), 2(*b*), and 2(*c*) are timing charts showing signals generated in the engine preheating system shown in FIG. 1.

FIGS. 2(*a*), 2(*b*), and 2(*c*) show how signals generated in the engine preheating system vary with time. FIG. 2(*a*) shows the signals in a mode of operation in which the keyswitch 4 is turned to connect the movable contact B to the starter contact ST within a preset preheating wait time for starting the engine. FIG. 2(*b*) shows the signals in a mode of operation in which the engine is started after elapse of a preset preheating wait time. FIG. 2(*c*) illustrates the signals in a mode of operation in which the keyswitch 4 is left as it is after the movable contact B is connected to the ignition contact IG and hence the engine is not started.

In the mode of operation shown in FIG. 2(*a*), while the glow indicator lamp 5 is being energized, a start signal is applied from the starter contact ST to the controller 6. The first relay 2 is then turned on to shift the relay switches 21, 22 to the broken-line position in FIG. 1, so that the battery 1 and the capacitor 3 are connected in series with each other with respect to the heating members 11. More specifically, when it is instructed to start the engine within a preheating wait time ti, the controller 6 processes a quick preheating sequence in which currents are supplied from both the battery 1 and the capacitor 3, thereby shortening the time required to preheat the heating members 11.

The time ti for which the glow indicator lamp 5 is to be energized is preset by the indicator timer in the controller 6 depending on the engine coolant temperature which is detected by the thermosensor 8. For example, the time ti may be in the range of from 6 seconds to 0.5 second, depending on the engine coolant temperature. A time ta, which is preset by the afterglow timer in the controller 6, is a time required for the battery 1 to supply a current for stable preheating after the charge relay 7 which instructs the starting of an afterglow function. Vehicle speed signals S1, S2 from the vehicle speed sensor 9 are used to establish a condition for the controller 6 to perform the afterglow function. For example, when the detected vehicle speed is 15 km/h, the vehicle speed signal S2 is generated, and the controller 6 inhibits the afterglow function in a speed range higher than 15 km/h.

Figure 3:
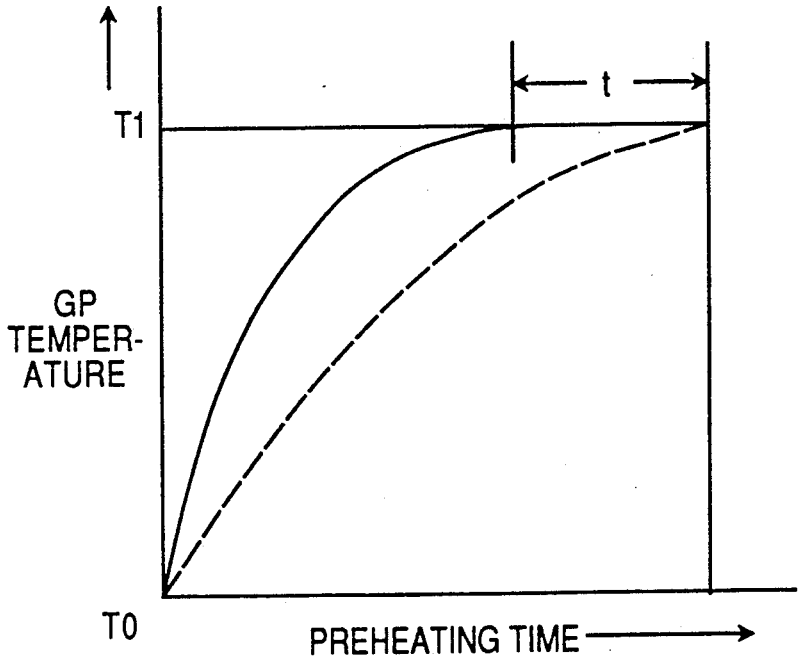
FIG. 3 is a graph showing how the temperature of a heating member increases with time.

FIG. 3 shows the manner in which the temperature of the heating members 11 increases, as indicated by the solidline curve, when the capacitor 3 and the battery 1 are connected in series with each other for quick preheating of the engine. The broken-line curve represents a temperature increase when the heating members are energized by only the battery 1, as is the case with the conventional engine preheating system. Study of FIG. 3 indicates that the preheating time required to reach a target temperature T1 from an initial temperature T0 is about $\frac{2}{3}$ of the preheating time with the conventional engine preheating system.

Figure 4:
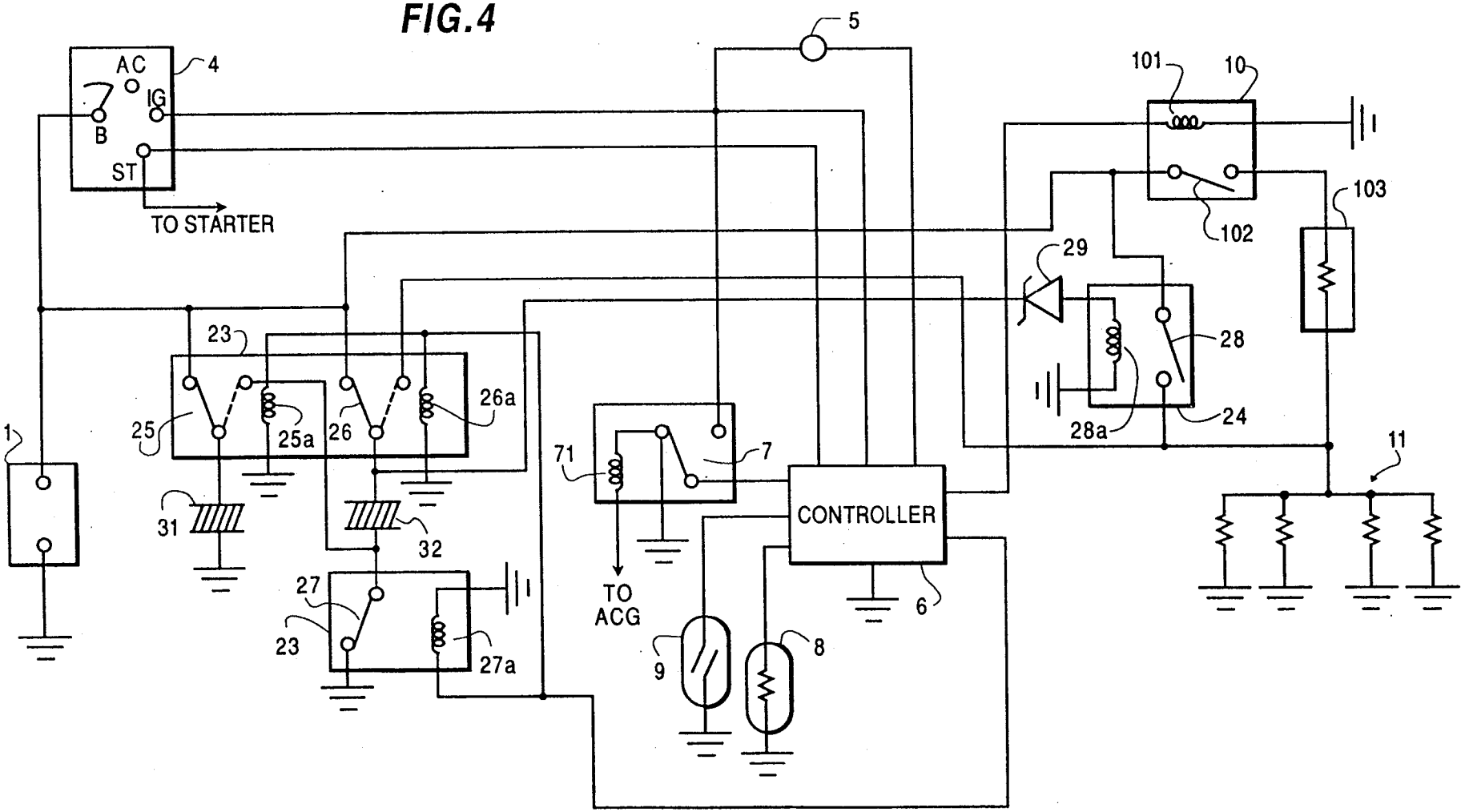
FIG. 4 is a block diagram of an engine preheating system according to another embodiment of the present invention.

FIG. 4 shows an engine preheating system according to another embodiment of the present invention. The engine preheating system shown in FIG. 4 differs from the engine preheating system shown in FIG. 1 in that there are two capacitors 31, 32 used instead of the capacitor 3, and a relay 23 having relay switches or contacts 25, 26, 27 is employed in place of the first relay 2, and that the two capacitors 31, 32 are connected in series with each other to energize the heating members 11 when a quick preheating sequence is instructed. The relay 23 has relay coils 25*a*, 26*a*, 27*a* for turning on the contacts 25, 26 and turning off the contact 27. A zener diode 29 serves to detect the voltage across the capacitors 31, 32 when they are connected in series with each other. The zener diode 29 can therefore detect the discharged condition of the capacitors 31, 32. When the voltage across the capacitors 31, 32 drops below a certain voltage, a contact 28 of a third relay 24 is turned on or closed by a relay coil 28*a* thereof, thereby directly connecting the battery and the heating members 11 to each other. The other components of the engine preheating system shown in FIG. 4 are identical to the corresponding parts shown in FIG. 1, and are denoted by identical reference numerals, and will not be described in detail.

Although certain preferred embodiments have been shown and described, it should be understood that many changes and modifications may be made therein without departing from the scope of the appended claims.

What is claimed is:

1. An engine preheating system for preheating a diesel engine, comprising:

a heating member heatable by a current flowing therethrough for heating the diesel engine;

a power supply for applying a voltage to said heating member;

a capacitor chargeable by said power supply; and connection control means for connecting said capacitor and said power supply in series with each other to charge said capacitor and to connect said capacitor and said heating element when the diesel engine is to be preheated quickly.

2. An engine preheating system according to claim 1, further including detecting means for detecting the voltage across said capacitor said connection control means comprising means for connecting said power supply directly to said heating member when the detected voltage drops below a predetermined voltage.

3. An engine preheating system according to claim 1, further comprising an additional capacitor chargeable by said power supply, when said additional capacitor is connected parallel to said capacitor with respect to said power supply by said connection control means, and wherein said connection control means connects said additional capacitor and said capacitor in series to said heating member when the diesel engine is to be preheated quickly.

4. An engine preheating system according to claim 3, further including detecting means for detecting the voltage across said capacitors, said connection control means comprising means for connecting said power supply directly to said heating member when the detecting voltage drops below a predetermined voltage.

* * * * *